US009464252B2

(12) United States Patent
Schwab et al.

(10) Patent No.: US 9,464,252 B2
(45) **Date of Patent: *Oct. 11, 2016**

(54) QUATERNARY AMMONIUM DETERGENT FUEL ADDITIVES

(71) Applicant: Afton Chemical Corporation, Richmond, VA (US)

(72) Inventors: Scott D. Schwab, Richmond, VA (US); Xinggao Fang, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 18 days.

This patent is subject to a terminal disclaimer.

(21) Appl. No.: 14/048,879

(22) Filed: Oct. 8, 2013

(65) Prior Publication Data

US 2015/0096528 A1 Apr. 9, 2015

(51) Int. Cl.

| | |
|---|---|
| ***C10L 1/18*** | (2006.01) |
| ***C10L 1/224*** | (2006.01) |
| ***C10L 1/22*** | (2006.01) |
| ***C10L 1/238*** | (2006.01) |
| ***C10L 10/04*** | (2006.01) |
| ***C10L 10/06*** | (2006.01) |

(52) U.S. Cl.

CPC ..... *C10L 1/224* (2013.01); *C10L 1/221* (2013.01); *C10L 1/238* (2013.01); *C10L 10/04* (2013.01); *C10L 10/06* (2013.01); *C10L 2200/0423* (2013.01); *C10L 2200/0446* (2013.01); *C10L 2200/0476* (2013.01)

(58) Field of Classification Search

CPC ..... C10L 10/04; C10L 10/06; C10L 1/221; C10L 1/224; C10L 1/238; C10L 2200/0423; C10L 2200/0446; C10L 2200/0476

USPC ..... 123/294; 44/403; 562/564

See application file for complete search history.

(56) References Cited

U.S. PATENT DOCUMENTS

| | | | | |
|---|---|---|---|---|
| 5,254,138 | A | 10/1993 | Kurek | |
| 6,133,209 | A * | 10/2000 | Rath et al. | 508/448 |
| 7,906,470 | B2 | 3/2011 | Stevenson et al. | |
| 7,947,093 | B2 | 5/2011 | Barton et al. | |
| 7,951,211 | B2 | 5/2011 | Barton et al. | |
| 8,083,814 | B2 | 12/2011 | Stevenson et al. | |
| 8,147,569 | B2 | 4/2012 | Barton et al. | |
| 2008/0113890 | A1 * | 5/2008 | Moreton et al. | 508/547 |
| 2010/0257779 | A1 | 10/2010 | Barton et al. | |
| 2012/0138004 | A1 * | 6/2012 | Stevenson et al. | 123/1 A |

FOREIGN PATENT DOCUMENTS

WO 2012004300 A1 1/2012

* cited by examiner

*Primary Examiner* — Latosha Hines

(74) *Attorney, Agent, or Firm* — Luedeka Neely Group, P.C.

(57) ABSTRACT

A fuel soluble additive for a diesel engine, a method for improving performance of fuel injectors and a method for cleaning fuel injectors for a diesel engine. The fuel soluble additive includes a quaternary ammonium salt derived from the reaction of (a) a hydrocarbyl amine containing at least one tertiary amino group, (b) an epoxide compound selected from a glycidol, a glycidyl ether, glycidyl ester, polyglycidyl ether, a polyglycidyl ester, and combinations thereof, wherein substituents of the glycidyl group have, on average, less than five carbon atoms per hetero atom, and (c) optionally a proton donor.

11 Claims, No Drawings

QUATERNARY AMMONIUM DETERGENT FUEL ADDITIVES

TECHNICAL FIELD

The disclosure is directed to a diesel fuel additive and to diesel fuels that include the additive that are useful for improving the performance of direct fuel injected engines. In particular the disclosure is directed to a quaternary ammonium salt fuel additive that is effective to enhance the performance of direct fuel injectors for diesel engines.

BACKGROUND AND SUMMARY

It is well known that liquid fuels contain components that can degrade during engine operation and form deposits. Such deposits can lead to incomplete combustion of the fuel resulting in higher emissions and poorer fuel economy. Detergents are well known additives in liquid fuels to help minimize deposit formation. However, as the dynamics and mechanics of an engine continually advance, the requirements of the fuels and additives must evolve to keep up with these engine advancements. For example, today's engines have injector system that have smaller tolerances and operate at higher pressure to enhance fuel spray to the compression or combustion chamber. Deposit prevention and reduction have become critical to optimal operation, and therefore there is a need for new detergents capable of providing acceptable performance in a liquid fuel to promote optimal engine operation.

Furthermore, there is a dramatic difference between indirect fuel injected diesel engines, and more modern high pressure common rail (HPCR), direct fuel injected diesel engines. Also, low sulfur diesel fuels and ultra low sulfur diesel fuels are now common in the marketplace for such engines. A "low sulfur" diesel fuel means a fuel having a sulfur content of 500 ppm by weight or less based on a total weight of the fuel. An "ultra low sulfur" diesel fuel (ULSD) means a fuel having a sulfur content of 15 ppm by weight or less based on a total weight of the fuel. Fuel injectors in an HPCR engine perform at much higher pressures and temperatures compared to older style engines and fuel injection systems. The combination of low sulfur or ULSD and HPCR engines have resulted in a change to the type of injector deposits and frequency of formation of injector deposits now being found in the marketplace.

Hence, fuel compositions for direct fuel injected engines often produce undesirable deposits on the internal engine surfaces and fuel filters. Accordingly, improved compositions that can prevent deposit build up, maintaining "as new" cleanliness for the vehicle life are desired. Ideally, the same composition that can clean up dirty fuel injectors, restoring performance to the previous "as new" condition, would be equally desirable and valuable in the attempt to reduce air borne exhaust emissions and to improve the power performance of the engines.

It is known to use polyisobutenyl succinimide (PIBSI)-derived quaternary ammonium salt detergents as additives in fuel compositions to promote optimal engine operation, for example, increased fuel economy, better vehicle drivability, reduced emissions and less engine maintenance by reducing, minimizing and controlling deposit formation. Such quaternized detergents are typically derived from PIBSI compounds that have pendant tertiary amine sites that can be alkylated, i.e. quaternized, by hydrocarbyl epoxides, such as propylene oxide. Examples of such reactions and reaction products are included in U.S. Pat. No. 8,147,569 and U.S. Publication No. 2012/0138004.

A new improved class of quaternary ammonium salt detergents derived from polyisobutenyl succinamides and/or esters have also been disclosed. Such additives are claimed to be more thermally stable than the PIBSI-derived quaternary ammonium detergents and may be manufactured by a less energy-intensive process.

Quaternary ammonium salts detergents often require the use of flammable and dangerous epoxides such as propylene oxide and further require the use of specialized and expensive pressure vessels for their production. The alkoxylation step requires a carboxylic acid as proton donor. The resulting carboxylate may lead to deposit formation and other issues related to carboxylate salts being present in the additive and fuel.

In addition, the polyisobutenyl succinamide and/or ester intermediates tend to be very viscous and difficult to handle during the manufacturing process. The reaction products often contain varying amounts of polyisobutenyl succinimides rendering it difficult to charge a correct amount of epoxide and or acid to the reaction mixture.

In addition, the detergency performance may still need improvement, particularly in fuels containing bio-diesel components.

The present disclosure relates to a class of more effective quaternary ammonium detergents which may be produced by the reaction of a tertiary amine with glycidol, glycidyl ether, and glycidyl ester. In general the substituent group of the glycidyl epoxide has less than five carbon atoms per hetero atom. Such epoxides are readily available in large quantities and require no special pressure reactor for handling.

In accordance with the disclosure, exemplary embodiments provide a fuel soluble additive and its preparation for a diesel engine, a fuel containing the additive, a fuel additive concentrate, a method for improving performance of fuel injectors and a method for cleaning fuel injectors for a diesel engine. The fuel additive includes a quaternary ammonium salt derived from the reaction of (a) a hydrocarbyl amine containing at least one tertiary amino group, (b) an epoxide compound selected from a glycidol, a glycidyl ether, glycidyl ester, polyglycidyl ether, a polyglycidyl ester, and combinations thereof, wherein the substituents of the glycidyl group have, on average, less than five carbon atoms per hetero atom, and (c) optionally a proton donor. The fuel additive concentrate comprises the fuel additive and one or more components and/or solvents.

Another embodiment of the disclosure provides a method of improving the injector performance of a direct fuel injected diesel engine. The method includes operating the engine on a diesel fuel composition containing a major amount of diesel fuel and from about 5 to about 200 ppm by weight based on a total weight of the fuel composition of a quaternary ammonium salt derived from (a) a hydrocarbyl amine containing at least one tertiary amino group, (b) an epoxide compound selected from a glycidol, a glycidyl ether, glycidyl ester, polyglycidyl ether, a polyglycidyl ester, and combinations thereof, wherein the substituents of the glycidyl group have, on average, less than five carbon atoms per hetero atom, and (c) optionally a proton donor.

In another embodiment is provided a fuel soluble additive for a fuel injected diesel engine comprising a quaternary ammonium salt derived from combining (a) a hydrocarbyl amine containing at least one tertiary amino group and (b) an epoxide compound selected from a glycidol, a glycidyl ether, glycidyl ester, polyglycidyl ether, a polyglycidyl ester, and combinations thereof, wherein the substituents of the glycidyl group have, on average, less than five carbon atoms per hetero atom, and (c) optionally a proton donor.

A further embodiment of the disclosure provides a method of operating a direct fuel injected diesel engine. The method includes combusting in the engine a fuel composition containing a major amount of fuel and from about 5 to about 200 ppm by weight based on a total weight of the fuel composition of a quaternary ammonium salt derived from (a) a hydrocarbyl amine containing at least one tertiary amino group (b) an epoxide compound selected from a glycidol, a glycidyl ether, glycidyl ester, polyglycidyl ether, a polyglycidyl ester, and combinations thereof, wherein the substituents of the glycidyl group have, on average, less than five carbon atoms per hetero atom, and (c) optionally a proton donor.

An advantage of the fuel additive described herein is that the additive may not only reduce the amount of deposits forming on fuel injectors, but the additive may also be effective to clean up dirty fuel injectors sufficient to provide improved power recovery to the engine.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The fuel additive component of the present application may be used in a minor amount in a major amount of fuel and may be added to the fuel directly or added as a component of an additive concentrate to the fuel. A particularly suitable fuel additive component for improving the operation of internal combustion engines may be made by reacting a tertiary amine of the formula

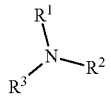

wherein each of $R^1$, $R^2$, and $R^3$ is selected from hydrocarbyl groups containing from 1 to 100 carbon atoms, with a proton donor and a glycidyl quaternizing agent to provide a glycidyl ether quaternary ammonium salt. The reaction may be conducted in the presence of a protonating agent having an acid disassociation constant ($pK_a$) of less than about 13, such as a carboxylic acid or an alkyl phenol. Regardless of how the quaternary ammonium salt is made, a key feature of the disclosure is that the amine contains at least one tertiary amino group.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form ring);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

Amine Compound

In one embodiment, an acylating agent may be reacted with a tertiary amine containing a nitrogen or oxygen atom capable of condensing with the acylating agent to form the hydrocarbyl amine containing at least one tertiary amino group. As used herein the term "acylating agent" means a long chain hydrocarbon, generally a polyolefin substituted with a monounsaturated carboxylic acid reactant such as (i) α,β-monounsaturated $C_4$ to $C_{10}$ dicarboxylic acid such as fumaric acid, itaconic acid, maleic acid; (ii) derivatives of (i) such as anhydrides or $C_1$ to $C_5$ alcohol derived mono- or di-esters of (i); (iii) α,β-monounsaturated $C_3$ to $C_{10}$ monocarboxylic acid such as acrylic acid and methacrylic acid; or (iv) derivatives of (iii) such as $C_1$ to $C_5$ alcohol derived esters of (iii) with any compound containing an olefinic bond represented by the general formula:

$$(R^4)(R^5)C{=}C(R^6)(CH(R^7)(R^8))$$

wherein each of $R^4$ and $R^5$ is, independently, hydrogen or a hydrocarbon based group. Each of $R^6$, $R^7$ and $R^8$ is, independently, hydrogen or a hydrocarbon based group; desirably at least one is a hydrocarbon based group containing at least 20 carbon atoms.

In another embodiment, a tertiary amine including diamines and polyamines may be reacted with a $C_1$ to $C_{54}$ carboxylic acid to form an amido amine and the amido amine may be subsequently reacted with a quaternizing agent. Suitable tertiary amido amine compounds of the formula

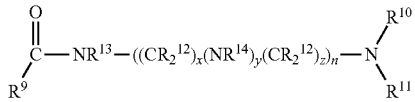

may be used, wherein each of $R^{10}$, and $R^{11}$ is selected from hydrocarbyl groups containing from 1 to 50 carbon atoms, each $R^9$, $R^{12}$, $R^{13}$ and $R^{14}$ may be independently selected from hydrogen or a hydrocarbyl group, x may range from 1 to 6, y may be 0 or 1, z may be 1 to 6, and n may range from 1 to 6. Each hydrocarbyl group $R^9$ to $R^{14}$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amino groups, and the like. Particularly suitable hydrocarbyl groups may be linear or branched alkyl groups. A representative example of an amine reactant which may be amidized and quaternized to yield compounds disclosed herein include for example, but are not limited to, dimethyl amino propyl amine.

If the amine contains solely primary or secondary amino groups, it may be desirable to alkylate at least one of the primary or secondary amino groups to a tertiary amino group prior to quaternizing the amido amine. In one embodiment, alkylation of primary amines and secondary amines or mixtures with tertiary amines may be exhaustively or partially alkylated to a tertiary amine and further alkoxylated to a quaternary salt.

Carboxylic Acid

When the tertiary amine also has a primary or secondary amino group, the tertiary amine may be converted to an amido amine by reacting the amine with a $C_1$ to $C_{54}$ carboxylic acid. The acid may be a monoacid, a dimer acid, or a trimer acid. The acid may be selected from the group consisting of formic acid, acetic acid, propionic acid, butyric acid, caprylic acid, capric acid, lauric acid, myristic acid, palmitic acid, stearic, arachidic acid, behenic acid, lignoceric acid, cerotic acid, myristoleic acid, palmitoleic acid, sapienic acid, oleic acid, elaidic acid, vaccenic acid, linoleic acid, linoelaidic acid, α-linolenic acid, arachidonic acid, eicosapentaenoic acid, erucic acid, docosahexaenoic acid, and the dimer and trimer acids thereof. When reacted with the amine, the reaction product may be a $C_1$-$C_{54}$-alkyl or alkenyl-substituted amido amine such as a $C_1$-$C_{54}$-alkyl or alkenyl-substituted amido propyldimethylamine.

Quaternizing Agent

A suitable quaternizing agents may be selected from the group consisting glycidol, a glycidyl ether, glycidyl ester, polyglycidyl ether, a polyglycidyl ester, and combinations thereof, wherein the substituents of the glycidyl group have, on average, less than five carbon atoms per hetero atom. Non-limiting examples of suitable glycidyl compounds that may be used as quaternizing agents may be selected from the group consisting of:

Allyl glycidyl ether
1,4-Butanediol diglycidyl ether
Diglycidyl 1,2-cyclohexanedicarboxylate
Diglycidyl ether
N,N-Diglycidyl-4-glycidyloxyaniline
Ethyl glycidyl ether
Furfuryl glycidyl ether
Glycerol diglycidyl ether
Glycerol triglycidyl ether
Glycidol
Glycidyl isopropyl ether
Glycidyl methacrylate
Glycidyl 4-methoxyphenyl ether
Glycidyl 2-methoxyphenyl ether
Glycidyl propargyl ether
1,6-hexanediol diglycidyl ether
4,4'-Methylenebis(N,N-diglycidylaniline)
Neopentyl glycol diglycidyl ether
Poly(ethylene glycol) diglycidyl ether,
Poly(propylene glycol) diglycidyl ether
Resorcinol diglycidyl ether
Trimethyol propane triglycidyl ether and combinations of two or more of the foregoing.

The quaternary ammonium salts from hydrocarbyl amines may be made in one stage or two stages. The reaction may be carried out by contacting and mixing the amine with the glycidyl ether in the reaction vessel wherein a carboxylic acid or alkyl phenol may be added, if necessary, to the reaction mixture to provide a protonating agent. The carboxylic acid may be selected from any of the above listed fatty acids, formic acid, acetic acid, propionic acid, butyric acid, polymeric acid and mixtures thereof, such a polyolefinic mono- or di-carboxylic acid, polymeric polyacids and mixtures thereof, and the like. An alkyl phenol protonating agent may be selected, without limitation, from a polyisobutenyl phenol, a dodecyl phenol, a nonyl phenol and the like. When used, the mole ratio of protonating agent per mole of epoxy equivalents added to the reaction mixture may range from about 0.5:10, for example from about 2:5, or from about 1:2 to about 2:1 moles of acid per mole of epoxy equivalents. In one embodiment, the anion of the quaternary ammonium salt is a carboxylate anion.

The reaction may be carried out at temperature ranging from about 30° to about 90° C., for example from about 45° to about 70° C. The reaction may be conducted by reacting any amount of tertiary amino groups to epoxy groups sufficient to provide a quaternary ammonium compound. In one embodiment a mole ratio of tertiary amino groups to epoxy groups may range from about 2:1 to about 1:2. When the reaction is completed volatiles and unreacted reagents may be removed from the reaction product by heating the reaction product under vacuum. The product may be diluted with mineral oil, diesel fuel, kerosene, or an inert hydrocarbon solvent to prevent the product from being too viscous, if necessary.

One or more additional optional compounds may be present in the fuel additive concentrate and/or the fuel compositions of the disclosed embodiments. For example, the fuels may contain conventional quantities of cetane improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, cyclomatic manganese tricarbonyl compounds, and the like. In some aspects, the compositions described herein may contain about 60 weight percent or less, or in other aspects, about 50 weight percent or less, based on the total weight of the additive concentrate, of one or more of the above additives. Similarly, the fuels may contain suitable amounts of conventional fuel blending components such as methanol, ethanol, dialkyl ethers, 2-ethylhexanol, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxyl)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357 issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

When formulating the fuel compositions of this application, the additives may be employed in amounts sufficient to reduce or inhibit deposit formation in a fuel system or combustion chamber of an engine. In some aspects, the fuels may contain minor amounts of the above described reaction product that controls or reduces the formation of engine deposits, for example injector deposits in diesel engines. For example, the diesel fuels of this disclosure may contain, on an active ingredient basis, an amount of the quaternary ammonium salt in the range of about 5 mg to about 200 mg of quaternary ammonium salt per kg of fuel, such as in the range of about 10 mg to about 100 mg of per kg of fuel or in the range of from about 30 mg to about 75 mg of the quaternary ammonium salt per kg of fuel. The active ingredient basis excludes the weight of (i) unreacted components associated with and remaining in the product as produced and used, and (ii) solvent(s), if any, used in the manufacture of the product either during or after its formation.

The additives of the present application, including the quaternary ammonium salt described above, and optional additives used in formulating the fuels of this invention may be blended into the base diesel fuel individually or in various sub-combinations. In some embodiments, the additive components of the present application may be blended into the diesel fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of diesel engine. The engine include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, fatty acid alkyl ester, gas-to-liquid (GTL) fuels, jet fuel, alcohols, ethers, kerosene, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol.

Accordingly, aspects of the present application are directed to methods for reducing the amount of injector deposits of engines having at least one combustion chamber and one or more direct fuel injectors in fluid connection with the combustion chamber. In another aspect, the quaternary ammonium salts described herein or fuel containing the quaternary ammonium salt may be combined with polyhydrocarbyl-succinimides, -Mannich compounds, -acids, -amides, -esters, -amide/acids and -acid/esters.

In some aspects, the methods comprise injecting a hydrocarbon-based compression ignition fuel comprising a quaternary ammonium salt of the present disclosure through the injectors of the diesel engine into the combustion chamber, and igniting the compression ignition fuel. In some aspects, the method may also comprise mixing into the diesel fuel at least one of the optional additional ingredients described above.

In one embodiment, the diesel fuels of the present application may be essentially free, such as devoid, of polyhydrocarbyl-succinimides, -Mannich compounds, -acids, -amides, -esters, -amide/acids and -acid/esters. The term "essentially free" is defined for purposes of this application to be concentrations having substantially no measurable effect on injector cleanliness or deposit formation.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Comparative Example 1

A quaternary ammonium salt was prepared by a method according to U.S. Pat. No. 8,147,569. To a mixture of PIBSI (reaction product of polyisobutenyl succinic anhydride (PIBSA) and dimethylaminopropyl amine (DMAPA), 1:1) (249 grams) made according to U.S. Pat. No. 8,147,569 and aromatic solvent aromatic (70 grams) was added acetic acid (17.3 grams), 1,2-butylene oxide (34.6 grams), isopropanol (64 grams), and 2-ethylhexanol (18 grams). The mixture was heated at 50° C. for 1 hour, then at 55° C. for 2 hours and 15 minutes, 60° C. for 2 hours, and 65° C. for 5 hours. Volatiles were removed under reduced pressure at 65° C. to give product as a brown viscous oil containing the quaternary ammonium salt.

Comparative Example 2

A quaternary ammonium salt was prepared by a method according U.S. Publication No. 2012/0138004. According to the procedure of "preparatory material A", a mixture of PIBSA (PIB Mn=950, 225 grams) and aromatic solvent (91 grams) was heated to 45° C. DMAPA (23.4 grams) was added over 10 minutes to keep the mixture temperature from rising above 60° C. It was found the reaction mixture was very viscous and was difficult to stir. The mixture was stirred at 60° C. for 2 hours. Then 2-ethyl hexanol (68 grams) and 1,2-butylene oxide (33.4 grams) were added to the reaction product. The resulting mixture was heated at 55° C. for 1 hour, 60° C. for 1 hour, 62.5° C. for 2 hours, and 65° C. for 1 hour. Volatiles were removed under reduced pressure to give the quaternary ammonium salt product as a brownish oil.

Inventive Example 1

Polyisobutenyl succinic anhydride (PIBSA) (139.07 grams, Average MW=980 g/mol, 0.142 moles), 14.39 grams dimethylamino propylamine (DMAPA, 0.141 moles) and 66.35 grams of Aromatic 150 solvent were placed in a 500 mL reaction flask equipped with a stirrer. The mixture was heated to 70° C. and held at that temperature for two hours with constant stirring. The resulting product was believed to consist mainly of polyisobutenyl DMAPA amide/acid (PDa).

Poly(propyleneglycol) diglycidyl ether (PPGDE) (45.00 grams, MW=640, 0.070 moles) and 51.94 grams of 2-ethylhexanol were added to the same flask containing the above PDa product. The mixture was heated to and held at 55° C. for 4 hours with constant stirring. From the carbon-NMR spectrum, the major product was believed to be:

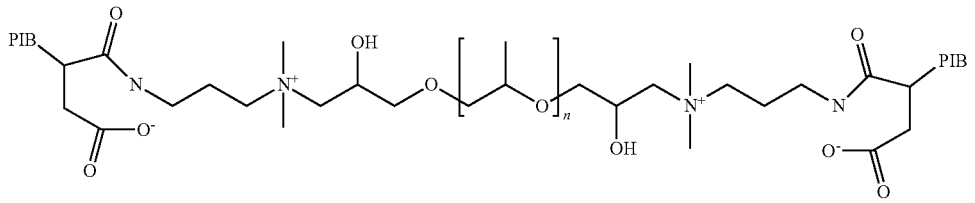

Inventive Example 2

A mixture of oleylamido propyl dimethylamine (183 grams), isopropyl glycidyl ether (IPGE, 58 grams), oleic acid (141 grams), and 2-ethylhexanol (80 grams) was heated at 60° C. for 4.5 hours under an inert atmosphere. The mixture was further heated at 65° C. for 2 hours to yield a product as a brownish oil.

Inventive Example 3

A product was made similar to that of inventive example 2 except that PDa (302 grams active) from Inventive Example 1 was used in place of oleylamido propyl dimethylamine. The mixture also contained 2-ethylhexanol (59 grams) and isopropyl glycidyl ether (IPGE) (32 grams). The mixture was heated at 55° C. for 2 hours, followed by 60° C. for 1.5 hours, and 65° C. for 2 hours to give product as a viscous oil.

Inventive Example 4

A tertiary amine was prepared according to Inventive Example 1 except that a $C_{20}$-$C_{24}$ alkenyl succinic anhydride was used in place of PIBSA and the reaction temperature was reduced to 65° C. The amine (250 grams) in an aromatic solvent (72 grams) was added to glycidol (36 grams) and 2-ethylhexanol (86 grams). The mixture was heated at 55° C. for 2 hours, followed by 60° C. for 3 hours, and 65° C. for 2.5 hours to give the product as an oil.

Inventive Example 5

A product was made similar to inventive example 4 except that PDa from Inventive Example 1 was used as the tertiary amine. The product was a brownish oil.

In the following example, an injector deposit test was performed on a diesel engine using an industry standard diesel engine fuel injector test, CEC F-98-08 (DW10) as described below. DW10 test was conducted with a B10 fuel (soy methyl ester, SME)

Diesel Engine Test protocol

A DW10 test that was developed by Coordinating European Council (CEC) was used to demonstrate the propensity of fuels to provoke fuel injector fouling and was also used to demonstrate the ability of certain fuel additives to prevent or control these deposits. Additive evaluations used the protocol of CEC F-98-08 for direct injection, common rail diesel engine nozzle coking tests. An engine dynamometer test stand was used for the installation of the Peugeot DW10 diesel engine for running the injector coking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The foregoing sequence was repeated four times. At the end of each hour, a power measurement was taken of the engine while the engine was operating at rated conditions. The injector fouling propensity of the fuel was characterized by a difference in observed rated power between the beginning and the end of the test cycle.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4000 RPM and full load to check for full power restoration after cleaning the injectors. If the power measurements were within specification, the test cycle was initiated. The following Table 1 provides a representation of the DW10 coking cycle that was used to evaluate the fuel additives according to the disclosure.

TABLE 1

One hour representation of DW10 coking cycle.

| Duration (minutes) | Engine speed (rpm) | Load (%) | Torque (Nm) | Boost air after Intercooler (° C.) |
|---|---|---|---|---|
| 2 | 1750 | 20 | 62 | 45 |
| 7 | 3000 | 60 | 173 | 50 |
| 2 | 1750 | 20 | 62 | 45 |
| 7 | 3500 | 80 | 212 | 50 |
| 2 | 1750 | 20 | 62 | 45 |
| 10 | 4000 | 100 | * | 50 |
| 2 | 1250 | 10 | 25 | 43 |
| 7 | 3000 | 100 | * | 50 |

TABLE 1-continued

| One hour representation of DW10 coking cycle. | | | | |
|---|---|---|---|---|
| Duration (minutes) | Engine speed (rpm) | Load (%) | Torque (Nm) | Boost air after Intercooler (° C.) |
| 2 | 1250 | 10 | 25 | 43 |
| 10 | 2000 | 100 | * | 50 |
| 2 | 1250 | 10 | 25 | 43 |
| 7 | 4000 | 100 | * | 50 |

Various fuel additives were tested using the foregoing engine test procedure in a PC-10 diesel fuel containing zinc neodecanoate, 2-ethylhexyl nitrate, and a fatty acid ester friction modifier (base fuel). A "dirty-up" phase consisting of base fuel only with no additive was initiated, followed by a "clean-up" phase consisting of base fuel with additive. All runs were made with 8 hour dirty-up and 8 hour clean-up unless indicated otherwise. The percent power recovery was calculated using the power measurement at end of the "dirty-up" phase and the power measurement at end of the "clean-up" phase. The percent power recovery was determined by the following formula $$\text{Percent Power recovery}=(DU-CU)/DU\times 100$$

wherein DU is a percent power loss at the end of a dirty-up phase without the additive, CU is the percent power at the end of a clean-up phase with the fuel additive, and power is measured according to CEC F98-08 DW10 test. The results are given in Table 2.

As shown by comparing Inventive Examples 4-8 to Comparative Examples 1-2 in the foregoing tables, the compositions made according to the invention are equivalent to the conventional quaternary ammonium salt compounds in petroleum diesel fuel and superior to conventional quaternary ammonium salt compounds in biodiesel fuel for cleaning up dirty fuel injectors.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

TABLE 2

| Additives and treat rate (ppm by weight) | Change in Power at end of DU (%) DU | Change in Power at end of CU (%) CU | Power recovery (PR %) (DU − CU)/DU × 100 | CU Efficiency (%) PR/(100 ppm * 8 hr) |
|---|---|---|---|---|
| Compound of Comparative Example 2 (75 ppm) | −5.75 | −0.09 | 98 | 16.3 |
| Compound of Inventive Example 1 (100 ppm) | −5.24 | 1.28 | 124 | 15.6 |
| Compound of Inventive Example 4 (75 ppm) | −4.14 | 0.07 | 102 | 17.0 |

Additional CEC F98-08 DW10 tests were conducted using a B10 fuel (soy methyl ester). The results are shown in the following Table 3

TABLE 3

| Additives and treat rate (ppm by weight) | Change in Power at end of DU (%) DU | Change in Power at end of CU (%) CU | Power recovery (PR %) (DU − CU)/DU × 100 | CU Efficiency (%) PR/(100 ppm * 8 hr) |
|---|---|---|---|---|
| Compound of Comparative Example 1 (100 ppm) | −5.87 | −2.93 | 50 | 6.2 |
| Compound of Inventive Example 1 (100 ppm) | −5.11 | −0.36 | 93 | 12 |
| Compound of Inventive Example 2 (50 ppm) | −5.51 | 0.48 | 109 | 27 |
| Compound of Inventive Example 3 (100 ppm) | −5.37 | −1.94 | 64 | 8 |
| Compound of Inventive Example 4 (75 ppm) | −2.87 | 1.61 | 156 | 26 |
| Compound of Inventive Example 5 (100 ppm) | −5.25 | 0.19 | 104 | 13 |

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel composition for a diesel engine comprising from about 5 to about 200 ppm by weight (0.0005 to 0.0200 wt.%) based on a total weight of the fuel composition of a fuel additive comprising a quaternary ammonium salt derived from the reaction of (a) a hydrocarbyl amine selected from the group consisting of acylated amines containing at least one tertiary amino group and amido amines of the formula

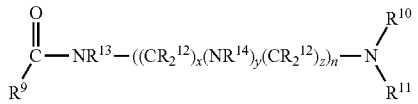

wherein each of $R^{10}$ and $R^{11}$ is selected from hydrocarbyl groups containing from 1 to 50 carbon atoms, each of $R^9$, $R^{12}$, $R^{13}$, and $R^{14}$ may be independently selected from hydrogen or a hydrocarbyl group, x ranges from 1 to 6, y is 0 or 1, z ranges from 1 to 6, and n ranges from 1 to 6, (b) an epoxide compound selected from the group consisting of a glycidol, a glycidyl ether, glycidyl ester, polyglycidyl ether, a polyglycidyl ester, and combinations thereof, wherein substituents of the glycidyl group have, on average, less than five carbon atoms per hetero atom, and (c) optionally a proton donor.

2. The fuel composition of claim 1, wherein the proton donor is selected from the group consisting of a carboxylic acid and an alkyl phenol.

3. The fuel composition of claim 2, wherein the proton donor is a carboxylic acid selected from the group consisting of fatty acids, formic acid, acetic acid, propionic acid, butyric acid, polyisobutenyl succinic acid, amide/acid, or acid/ester, and polymeric acids, and mixtures thereof.

4. The fuel composition of claim 1 comprising from about 10 to about 100 ppm of the fuel additive based on a total weight of the fuel composition.

5. A method of improving the injector performance of a fuel injected diesel engine comprising operating the engine on a fuel composition comprising a major amount of fuel and from about 5 to about 200 ppm by weight (0.0005 to 0.0200 wt.%) based on a total weight of the fuel composition of a quaternary ammonium salt derived from the reaction of (a) a hydrocarbyl amine selected from the group consisting of acylated amines containing at least one tertiary amino group and amido amines of the formula

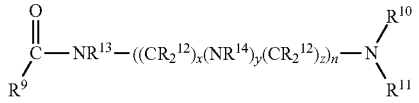

wherein each of $R^{10}$ and $R^{11}$ is selected from hydrocarbyl groups containing from 1 to 50 carbon atoms, each of $R^9$, $R^{12}$, $R^{13}$, and $R^{14}$ may be independently selected from hydrogen or a hydrocarbyl group, x ranges from 1 to 6, y is 0 or 1, z ranges from 1 to 6, and n ranges from 1 to 6 , (b) an epoxide compound selected from the group consisting of a glycidol, a glycidyl ether, glycidyl ester, polyglycidyl ether, a polyglycidyl ester, and combinations thereof, wherein substituents of the glycidyl group have, on average, less than five carbon atoms per hetero atom, and (c) optionally a proton donor.

6. The method of claim 5, wherein the engine comprises a direct fuel injected diesel engine.

7. The method of claim 5, wherein the fuel composition contains from about 10 to about 200 ppm of the quaternary ammonium salt based on a total weight of the fuel composition.

8. The method of claim 5, wherein the fuel comprises a biodiesel fuel.

9. A method of operating a diesel engine comprising combusting in the engine a fuel composition comprising a major amount of fuel and from about 5 to about 200 ppm by weight (0.0005 to 0.0200 wt.%) based on a total weight of the fuel composition of a quaternary ammonium salt derived from the reaction of (a) a hydrocarbyl amine selected from the group consisting of acylated amines containing at least one tertiary amino group and amido amines of the formula

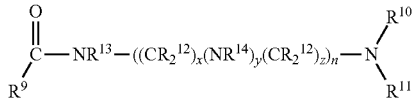

wherein each of $R^{10}$ and $R^{11}$ is selected from hydrocarbyl groups containing from 1 to 50 carbon atoms, each of $R^9$, $R^{12}$, $R^{13}$, and $R^{14}$ may be independently selected from hydrogen or a hydrocarbyl group, x ranges from 1 to 6, y is 0 or 1, z ranges from 1 to 6, and n ranges from 1 to 6 , (b) an epoxide compound selected from the group consisting of a glycidol, a glycidyl ether, glycidyl ester, polyglycidyl ether, a polyglycidyl ester, and combinations thereof, wherein substituents of the glycidyl group have, on average, less than five carbon atoms per hetero atom, and (c) optionally a proton donor.

10. The method of claim 9, wherein the proton donor is a carboxylic acid selected from the group consisting of fatty acids, formic acid, acetic acid, propionic acid, butyric acid, polyisobutenyl succinic acid, amide/acid, or acid/ester, and polymeric acids, and mixtures thereof.

11. The method of claim 9, wherein the fuel comprising a biodiesel fuel.

* * * * *